US012758008B2

(12) United States Patent
Van Raalte et al.

(10) Patent No.: US 12,758,008 B2
(45) **Date of Patent: *Oct. 13, 2026**

(54) FOLDABLE FURNITURE ASSEMBLY

(71) Applicant: FURNIGAMI INC., Denver, CO (US)

(72) Inventors: Nicholas Van Raalte, Denver, CO (US); Michael Yim, San Jose, CA (US); Jonathan Thai, San Jose, CA (US); David Suttie, Galesville, WI (US); Blake Johnson, Hilo, HI (US); Peter Van Raalte, Briarcliff Manor, NY (US)

(73) Assignee: FURNIGAMI INC., Denver, CO (US)

( * ) Notice: Subject to any disclaimer, the term of this patent is extended or adjusted under 35 U.S.C. 154(b) by 36 days.

This patent is subject to a terminal disclaimer.

(21) Appl. No.: 19/022,670

(22) Filed: Jan. 15, 2025

(65) Prior Publication Data

US 2025/0151893 A1 May 15, 2025

Related U.S. Application Data

(63) Continuation of application No. 18/924,666, filed on Oct. 23, 2024, now Pat. No. 12,232,609.

(60) Provisional application No. 63/592,735, filed on Oct. 24, 2023.

(51) Int. Cl.

| | |
|---|---|
| ***A47B 3/083*** | (2006.01) |
| ***A47C 4/20*** | (2006.01) |
| *A47B 3/08* | (2006.01) |

(52) U.S. Cl.

CPC ..... *A47B 3/083* (2013.01); *A47C 4/20* (2013.01); *A47B 2003/0821* (2013.01)

(58) Field of Classification Search

CPC . A47B 3/083; A47B 3/087; A47B 2003/0835; A47B 2003/0821; A47C 4/20; A47C 4/22

USPC ..... 108/116, 117, 132

See application file for complete search history.

(56) References Cited

U.S. PATENT DOCUMENTS

| | | | | |
|---|---|---|---|---|
| 6,520,459 | B2 | 2/2003 | Burr | |
| 6,969,112 | B1 | 11/2005 | Sherrill | |
| 7,121,620 | B1 | 10/2006 | Fang | |
| 8,985,545 | B2 | 3/2015 | Chiu | |
| 12,232,609 | B1 * | 2/2025 | Van Raalte | A47C 7/008 |
| 2007/0039524 | A1 | 2/2007 | Pearson | |

(Continued)

OTHER PUBLICATIONS https://web.archive.org/web/20231004092649/https://www.rei.com/product/158016/helinox-chair-one (cached on Oct. 4, 2023).

(Continued)

*Primary Examiner* — Jose V Chen

(74) *Attorney, Agent, or Firm* — Leonid Kisselev

(57) ABSTRACT

A furniture assembly is provided that allows to independently adjust height of furniture legs and thus adjust the angle at which the user-interfacing surface of the furniture, such as seat or tabletop, are positioned. This feature allows to set up the furniture for office-type use even in the outdoors and to compensate for sloped or otherwise uneven terrain. The furniture assembly can take form a chair, a sofa, or a table, with all of these furniture items being easily and conveniently foldable and unfoldable to allow for easy transport. Multiple safety features promote the furniture in staying in folded or unfolded configuration, as desired by the user, and prevent accidental change of configuration.

20 Claims, 14 Drawing Sheets

(56) References Cited

U.S. PATENT DOCUMENTS

| | | | | |
|---|---|---|---|---|
| 2012/0181819 | A1 | 7/2012 | Smith | |
| 2017/0265640 | A1 | 9/2017 | Du | |
| 2019/0298054 | A1 | 10/2019 | Clegg | |
| 2020/0054139 | A1 | 2/2020 | Morley | |
| 2020/0260863 | A1 | 8/2020 | Leng | |
| 2022/0354245 | A1 | 11/2022 | Choi | |
| 2023/0276936 | A1* | 9/2023 | Chen | A47B 3/0803 108/147.19 |
| 2023/0301438 | A1 | 9/2023 | Sherer | |
| 2024/0108141 | A1 | 4/2024 | Nelson | |

OTHER PUBLICATIONS https://web.archive.org/web/20230325165520/https://pecosoutdoor.com/products/the-pecos-table/?variant=41111205216461 (cached on Aug. 25, 2023).

https://web.archive.org/web/20210917193817/https://www.snowpeak.com/collections/chairs/at-home (cached on Sep. 17, 2021).

"Oru 'Camp' Launches Origami Furniture for the Outdoors," Gearjunkie, by Adam Ruggiero, May 8, 2023, https://gearjunkie.com/camping/oru-camp-origami-furniture-outdoor.

https://web.archive.org/web/20230826185652/https://www.rei.com/product/174101/yeti-trailhead-camp-chair (cached on Aug. 26, 2023).

"Vingli Oversized Fishing Chair Heavy Duty Support 440 lbs, 160° Freely Adjustable Reclining Folding Chairs, Lounge Travel Outdoor Seat with High Back for Fishing Camping or Leisure," https://www.amazon.com/VINGLI-Professional-Foldable-Adjustable-Reclining/dp/B07DCPS8ZK?ref_=ast_sto_dp&th=1 (product first available May 29, 2018).

4ft Folding Table, Indoor & Outdoor Heavy Duty Portable Table, Folding Picnic Table, Folding Card Table for Picnic, Party, Camping(4ft), https://www.amazon.com/Camp-Field-Folding-Outdoor-Portable/dp/B0CRDHRG2W?th=1 (product available as of at least Apr. 3, 2024).

Villey Folding Camping Square Table with Carry Bag, Lightweight Aluminum Adjustable Square Table for Outdoor, Camping, Picnic, Backyards, BBQ (S), Amazon.com: Customer reviews: Villey Folding Camping Square Table with Carry Bag, Lightweight Aluminum Adjustable Square Table for Outdoor, Camping, Picnic, Backyards, BBQ (S) (product available as of at least Aug. 24, 2024).

* cited by examiner

100

FOLDABLE FURNITURE ASSEMBLY

FIELD

This application relates in general to furniture, and in particular, to a foldable furniture assembly.

BACKGROUND

As people's lifestyles become more mobile, the demand for furniture that can help them maintain familiar comforts and accommodations in different environments also increases. For instance, whereas previously people often separated camping from their work lives, the rise of digital nomads sees more people that want to be able to perform office-type work while located in an outdoors environment and thus require furniture that can be used to support this activity for an extended amount of time, such as chairs, couches, and tables. Such furniture must allow to maintain a comfortable posture, generally in a sitting position, for an extended period of time while working on a computer (such as a laptop) ergonomically positioned for easy viewing and typing by the user. While the structure and function of such furniture for use with typical home and office environment has generally been well-established, the furniture for use in atypical environments faces is subject to many additional requirements that complicate such furniture's design. One of those requirements is that the furniture has to be portable, being easy to transport and set up in the outdoors. Further, while the surface upon which such furniture is set up tends to be flat in an office or a residential environment, the ground tends to be uneven in the outdoors and the structure of the furniture used in the outdoors has to compensate for this unevenness to provide a comfortable user experience.

While attempts have been made to provide portable furniture that be used in the outdoors, such attempts fall short. For example, furniture sold under the brand Helinox® sells foldable furniture, including chairs, that can be used in the outdoors. While the furniture is generally lightweight, the chairs are designed to have the center of gravity of the person sitting in them towards the back of the chair and close to the ground. While such positioning is conductive towards lounging in the chair, the positioning is inconvenient when the person sitting in the chair is trying to work on a laptop positioned in front of the person (such as on a table). Further, the legs of such a chair are not sufficiently adjustable to allow for effective positioning of the chair on uneven ground, thus making the chairs of use only on flat ground. Further, the high price of such chairs limits the availability of such chairs for a large number of consumers.

Furniture sold under the brand Snow Peak™ have similar deficiencies. While sporting a minimalist design and a high price, the chairs sold under this brand are designed to have a low center of gravity of the person sitting in them, thus being also comfortable to lounge in but uncomfortable for working on a laptop. Likewise, the legs of such furniture are not sufficiently adjustable to allow for comfortable use on an uneven ground.

Likewise, certain furniture sold under the brand Oru® is made out of the same materials as certain kayaks. While lightweight and convenient for use on a beach on even ground, such furniture does not include legs sufficiently adjustable to be comfortable for work-related use on an uneven ground.

Further, camping chairs sold under the brand Yeti® are collapsible and storable in a bag. However, despite their portability, the chairs lack legs sufficiently adjustable to make such chairs useful for working while on an uneven ground.

Accordingly, there is a need for foldable furniture that can be easily transported to outdoor environments and that allows to user to engage in extended office-type work even when in an outdoors environment with an uneven ground.

SUMMARY

A furniture assembly is provided that allows to independently adjust height of furniture legs and thus adjust the angle at which the user-interfacing surface of the furniture, such as seat or tabletop, are positioned. This feature allows to set up the furniture for office-type use even in the outdoors and to compensate for sloped or otherwise uneven terrain. The furniture assembly can take form a chair, a sofa, or a table, with all of these furniture items being easily and conveniently foldable and unfoldable to allow for easy transport. Multiple safety features promote the furniture in staying in folded or unfolded configuration, as desired by the user, and prevent accidental change of configuration.

In one embodiment, a foldable furniture assembly is provided. The assembly includes a plurality of leg joints, each leg joint including a plurality of indentations; a plurality of ratchet leg sleeves, each of the ratchet sleeves fittable around one of the joint legs and movable along at least a portion of a length of that leg joints along the indentations; a plurality of toggles, each of the toggles configured to secure one of the ratchet leg sleeves to one of the leg joints using one of the indentations; and a base frame attachable to a body of a furniture item and including a plurality of leg sleeve sub-assemblies rotatably attachable to a central sub-assembly, the sub-assemblies including a plurality of outer leg sleeves, wherein each of the leg joints is insertable into one of the outer leg sleeves to a level on which the ratchet leg sleeve is set on that leg joint, wherein the leg sleeve subassemblies are configured to rotate relative to the central sub-assembly when the furniture item switches from an unfolded configuration to a folded configuration.

Still other embodiments will become readily apparent to those skilled in the art from the following detailed description, wherein are described embodiments by way of illustrating the best mode contemplated. As will be realized, other and different embodiments are possible and the embodiments' several details are capable of modifications in various obvious respects, all without departing from their spirit and the scope. Accordingly, the drawings and detailed description are to be regarded as illustrative in nature and not as restrictive.

DETAILED DESCRIPTION

Throughout this description, references to orientation (e.g., front(ward), rear(ward), top, bottom, back, right, left, upper, lower, etc.) of the furniture components relate to their position when in use and are used for ease of description and illustration only. No restriction is intended by use of the terms regardless of how the furniture components are situated on their own.

Figure 1:
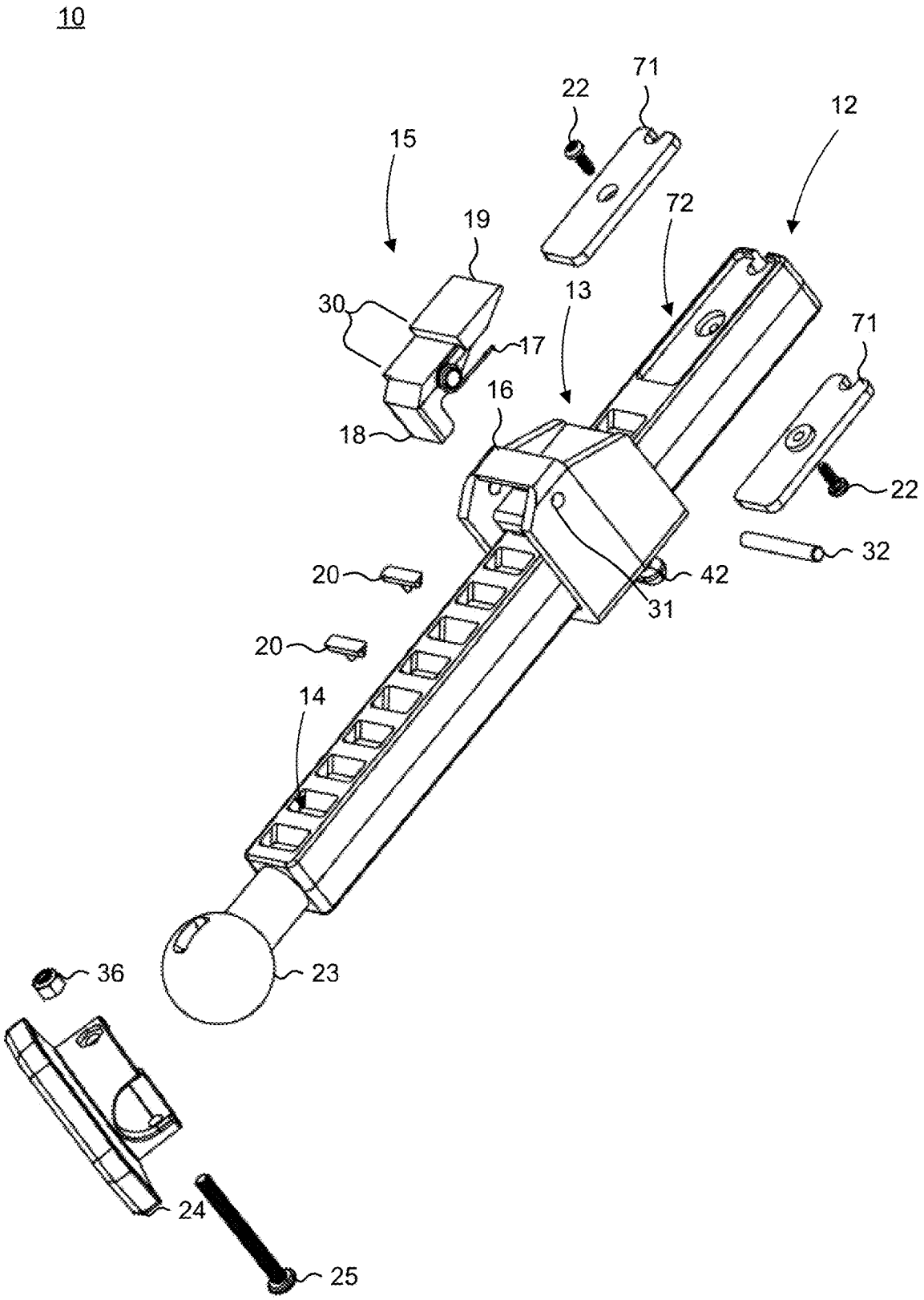
FIG. 1 is a diagram showing a leg joint assembly that is a part of a legin accordance with one embodiment.
Figure 10:
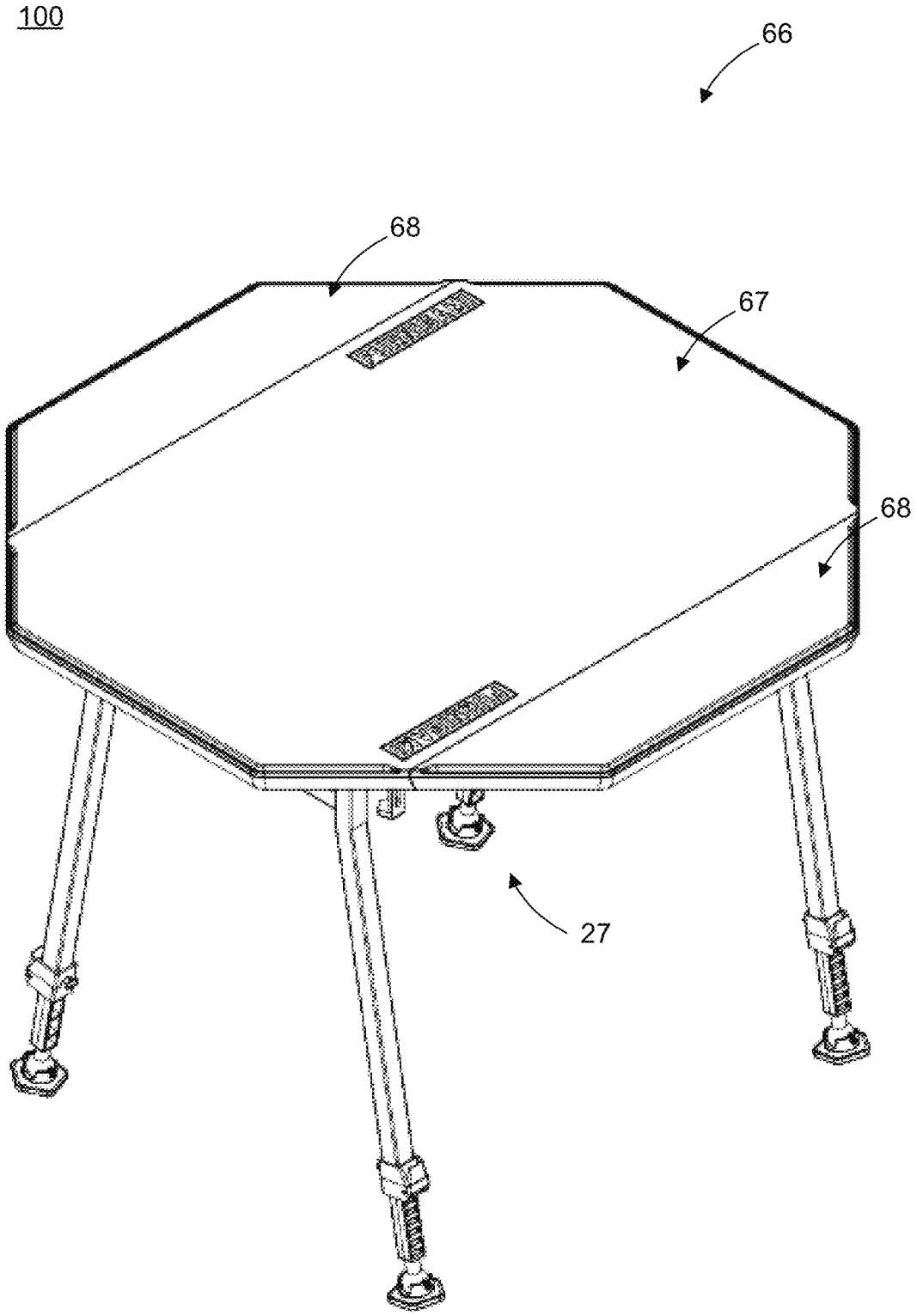
FIG. 10 is a diagram of the furniture assembly forming a table in accordance with one embodiment.

Depending on the embodiment, the furniture assembly 100 described below can form a chair (seen in FIG. 7), a sofa (seen in FIG. 8), and table (seen in FIG. 10). In all of the embodiments, the furniture assembly includes four legs 11 (shown beginning with reference to FIG. 2) whose length can be adjusted to a great extent and independently of each, thus allowing to allow the portion of the furniture assembly 100 with which a user is directly interfacing (such as a seat of a chair or a sofa or a tabletop of a table) to be set evenly (or at another desired angle) even when positioned on an uneven terrain in the outdoors. FIG. 1 is a diagram showing a leg joint assembly 10 that is a part of a leg 11 in accordance with one embodiment. The leg joint assembly of the leg 11 shown in FIG. 1 includes a leg joint 12 upon which a ratchet leg sleeve 13 is set. The leg joint 12 includes multiple indentations 14 and the position of the ratchet leg sleeve 13 is adjustable along the length of the leg joint 12. The position of the ratchet leg sleeve 13 along the leg joint is secured by a toggle 15 that is engaged to the ratchet leg sleeve 13, with the central portion 30 of the toggle being inserted under a bar 16 formed on the ratchet leg sleeve 13. The ratchet leg sleeve 13 further includes apertures 31 through which a pin 32 is inserted; the bottom surface of the toggle 15 pivots around the pin when inserted into the ratchet leg sleeve 13. The toggle 15 includes a torsion spring 17 that pushes the toggle 15 against the bar 16 (thus securing the toggle 15 to the ratchet leg sleeve 13) and pushing one end 18 of the toggle 15 into one of the indentations 14 of the leg joint 12, thus securing the toggle's 15 position along the leg joint 12. When changing the position of the ratchet leg sleeve 13 along the leg sleeve 13 is necessary, pressure can be applied on the end 19 of the leg sleeve that is not inserted into the indentation 14, thus removing the end 18 from the indentation and allowing to change the position of the ratchet leg sleeve 13 along the leg joint 12, with the removal of the pressure from the end 19 resulting in the insertion of the end 18 into another one of the indentations and securing the new ratchet leg sleeve 13 in the new position. In one embodiment, the position is adjustable by half an inch (with a change of the toggle from one indentation 14 to an adjacent indentation 14), though in a further embodiment, other increments of position change are possible. Optionally, markers 20 can be removably inserted into the indentations to mark particular indentations 14 to be used for a particular terrain setting.

To prevent the ratchet leg sleeve 13 from sliding from the end of the leg joint 12 furthest away from the ground, the end 72 of the leg joint 12 can include ratchet leg retainers 71, which can be secured to the leg joint 12 with bolts 22, though other ways to secure the inserts are also possible. As the leg joints 12 can be made of metal, to lighten the weight of the leg joints, in addition to having indentations, the leg joints 12 can be hollow and have other openings to reduce the amount of metal used.

The end of the leg joint 12 that is closest to the ground when the furniture assembly is in use includes a ball joint 23. A foot joint 24 that makes contact with the ground is set on the ball joint 23 and can be secured to the ball joint 23 with a bolt 25 and a screw 36 inserted through a tapered slot 35 in the ball joint 23, though other ways to secure the foot joint 24 to the ball joint 23 are possible. As significant latitude for positioning the bolt 25 within the ball joint exists, rotation of the foot joint 24 around the ball joint 23 is possible. Thus, when the furniture assembly is to be set up, the foot joint 24 can face the ground. However, when the furniture assembly is folded for storage, the ball joint 23 can be rotated to shift the foot joint 24 to be parallel to be on the side of the ball joint 23 that is not facing the ground, thus simplifying the storage of the leg joint 12.

Figure 2:
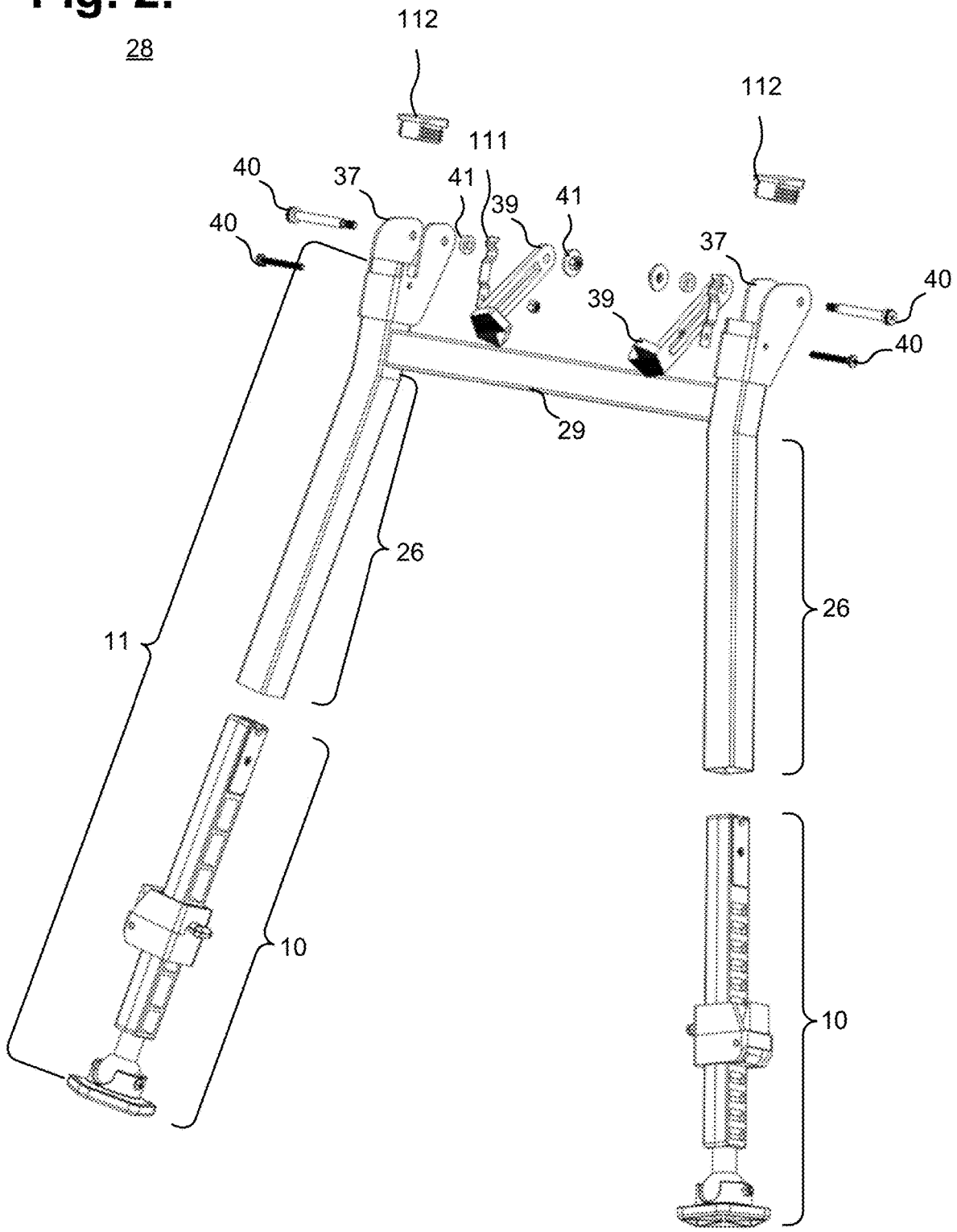
FIGS. 2 and 3 are diagrams showing leg sub-assemblies of a base frame used for forming a chair, with each frame sub-assembly including two outer leg sleeves in accordance with one embodiment.
Figure 3:
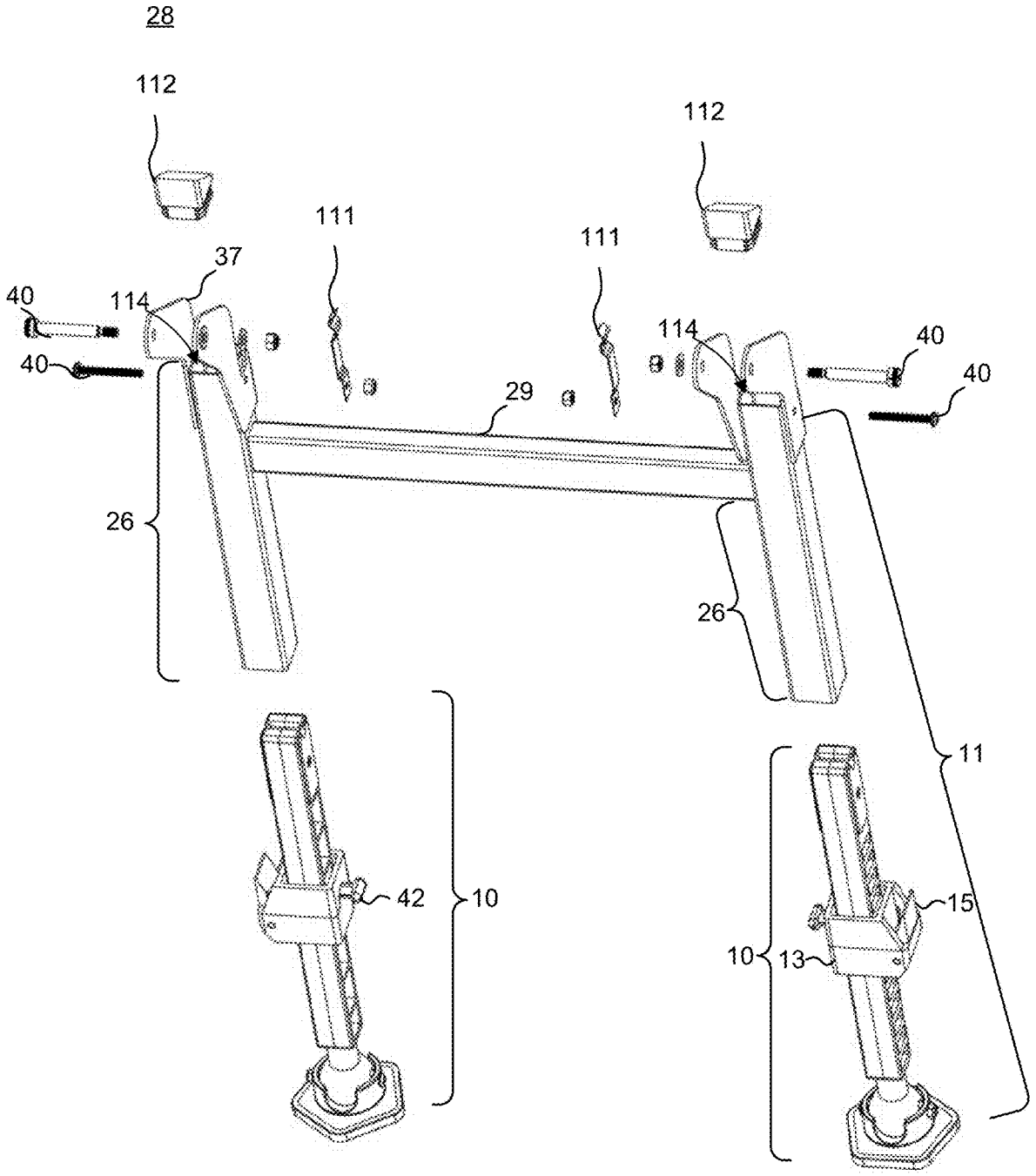

The ratchet leg sleeves 13 on at least two of the leg joints further include a knob 42 formed on a side of the sleeve 13 opposite to the side on which the sleeve 13 engages the toggle 15 (though in a further embodiment, other positioning is possible) that is used to secure the legs 11 in one spot when the furniture assembly is in a folded configuration, as further described below with reference to FIGS. 2 and 3.

The legs 11 further include outer leg sleeves 26 into which the leg joints are insertable. FIGS. 2 and 3 are diagrams showing leg sub-assemblies 28 of a base frame 27 used for forming a chair, with each frame sub-assembly 28 including two outer leg sleeves 26 in accordance with one embodiment. FIGS. 2 and 3 further show leg joints 12 insertable into those outer leg sleeves 26. The leg joints 12 are insertable into outer leg sleeves 26 to a depth determined by the position of the leg sleeve ratchets 24, with the leg joints 12 being unable to pass into the outer leg sleeves beyond the level that the leg ratchet sleeve 13 is set on them. Thus, the overall length of each of the legs 11 is determined by which indentation 14 on the leg joint 12 the ratchet leg sleeve 13 is secured into, and thus the leg of each of the legs 11 is adjustable by adjusting which indentation the ratchet leg sleeve 13 of that leg sleeve 12 is secured into. Each outer leg sleeve 26 is secured over a top portion of the ratchet leg sleeve 13, fitting tightly over the ratchet leg sleeve 13 and thus the ratchet leg sleeve 13 being retained in the outer leg sleeve 26 due to friction and gravity (when the legs 11 are set on the ground), and requiring user action for removal of the leg joint 12 from the outer leg sleeve 26.

Figure 4:
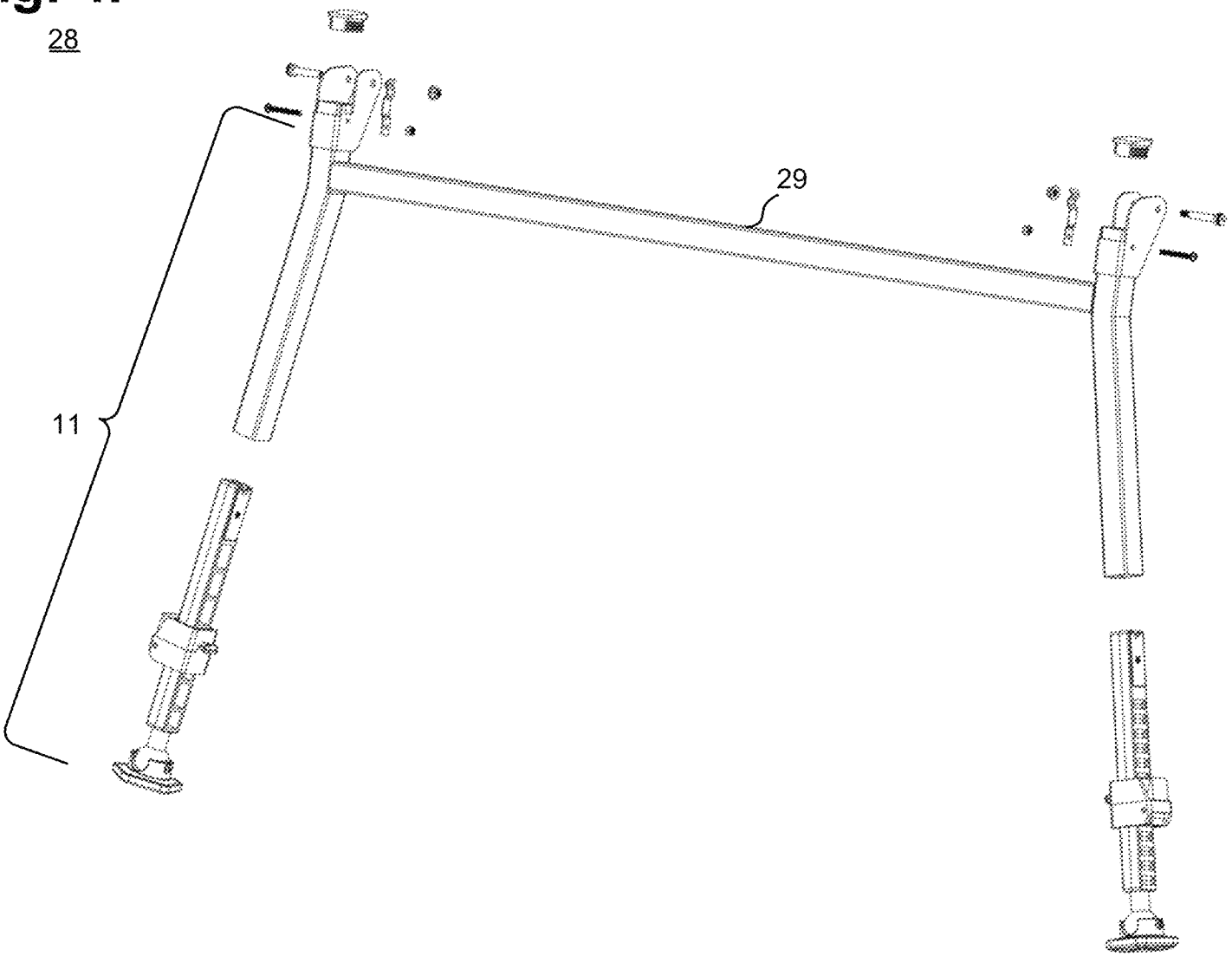
FIG. 4 is a diagram showing a leg sleeve sub-assembly in the embodiment where the furniture assembly is a sofa in accordance with one embodiment.

The outer leg sleeves 26 are part of a leg sleeve sub-assembly 28, with the sub-assembly 28 including a bar 29 (also referred to as a connector 29) connecting the outer leg sleeves 26. The length of the connector 29 depends on what kind of furniture the furniture assembly implements, with the bar 29 being shorter in the case of a chair and longer in the case of a sofa or a table. For examples, FIGS. 2 and 3 show the leg sleeve sub-assemblies 28 in the embodiment where the furniture assembly 100 is a chair. FIG. 4 is a diagram showing a leg sleeve sub-assembly 28 in the embodiment where the furniture assembly is a sofa in accordance with one embodiment, with the bar 29 shown in FIG. 4 being longer than the bars 29 shown in FIGS. 2 and 3. As further described below, the base frame 27 includes two leg sleeve sub-assemblies 28, thus including four legs 11 in the furniture assembly. In other respects not described herein, the leg sleeve sub-assemblies 28 used for forming a chair and a sofa can be identical.

Figure 6:
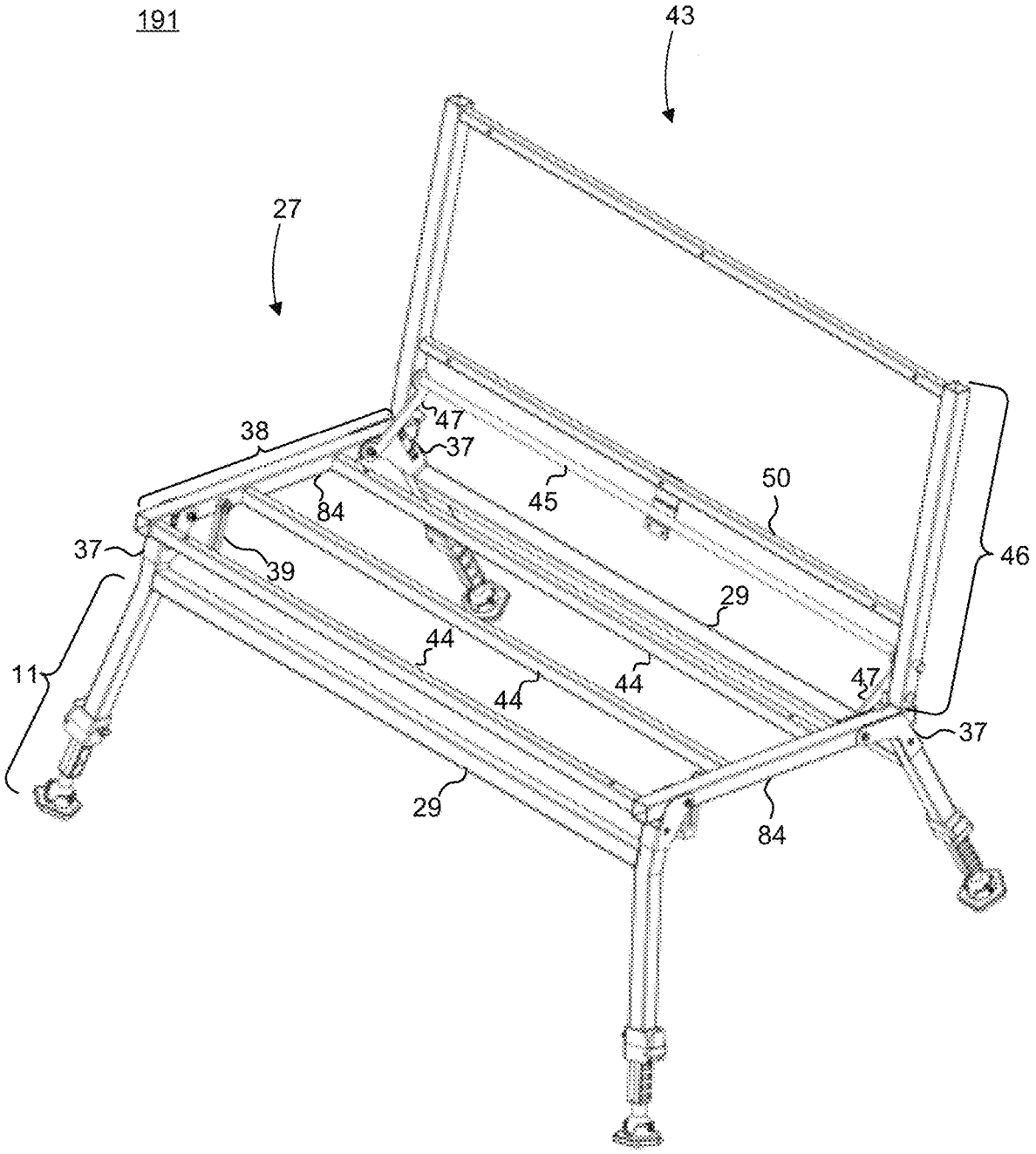
FIG. 6 is a diagram showing a sofa frame that includes a base frame pivotally connected to a backrest frame in accordance with one embodiment.
Figure 11:
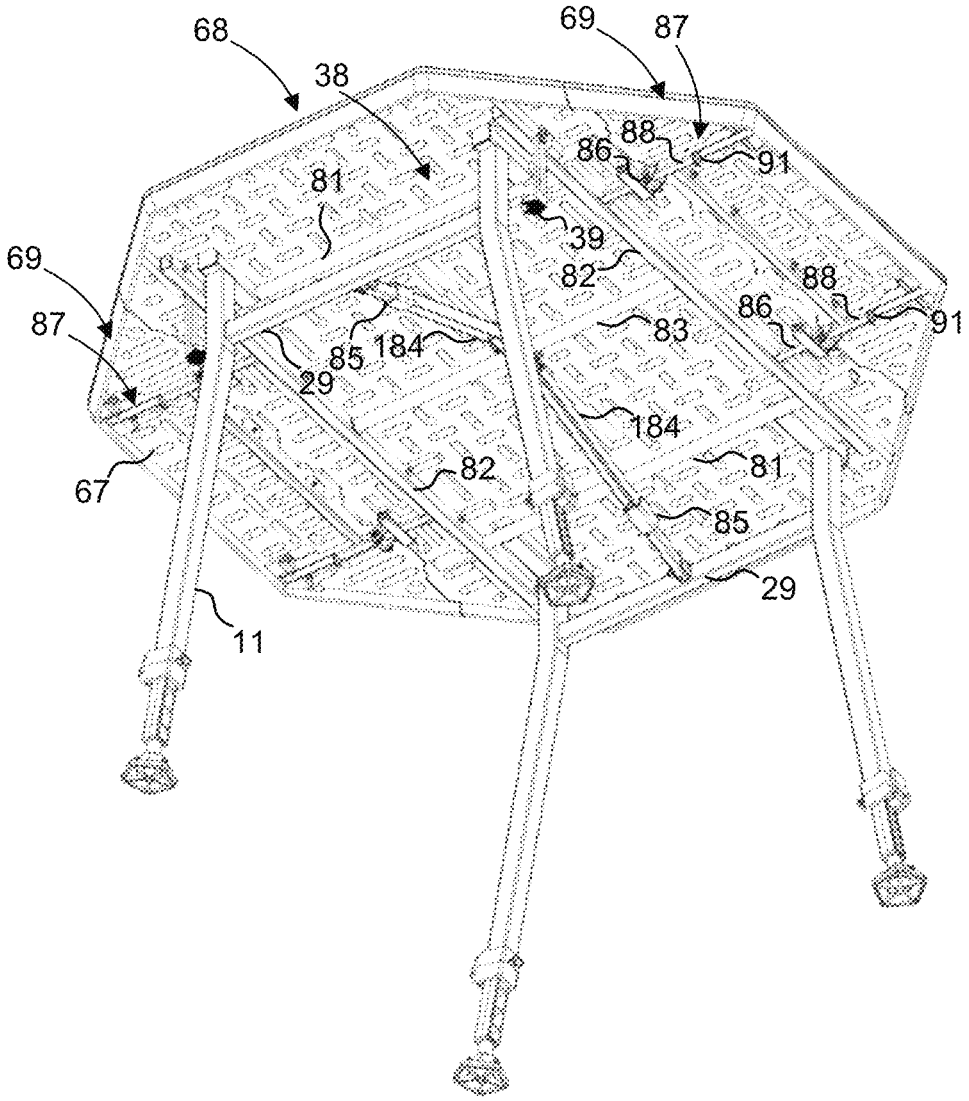
FIG. 11 is a diagram showing a side of the table top 66 that is attached to the base frame in accordance with one embodiment.

As further described below, the furniture assemblies can transition into folded and unfolded configuration and the two leg sleeve sub-assemblies 28 are used to keep the furniture assembly in the folded configuration. Each of the two leg sleeve sub-assemblies 28 includes mounts 37 upon which, as further described below, a central sub-assembly 38 connecting the sub-assemblies 28 into the base frame 27 are mounted. As shown with reference to FIG. 2, on one of the leg sleeve sub-assemblies 28, a retention clip 39 to each of the mounts of that leg-sleeve sub-assembly. When used as part of the assembly 100 that forms a chair, the retention clips 39 are mounted on the sides of the mounts 37 that face each other, such as via bolts 40 and screws 41, though other ways to mount retention clips 39 to the mounts 37 are possible. When used as part of the assembly 100 that forms a sofa or a table, the retention clips can be mounted on other portions of the base frame 27, such as on the bar 84 (as seen in FIG. 6 in the case of the sofa) or bar 82 (as seen in FIG. 11 in the case of the table). When the furniture assembly is in a closed configuration, the knobs 42 on leg joints 12 inserted into outer leg sleeves 26 of a first leg sleeve sub-assembly 28 are brought next to the retention clips 39 mounted on the mounts 37 of the second leg sleeve sub-assembly 28 (or another portion of the base frame 27 proximate to the mount 37 of the second leg sub-assembly 28) and the knobs 42 are hooked to the retention clips 39, which prevents the two leg sleeve sub-assemblies 28 from disengaging unless a user unhooks the knobs 42 from the retention clips 39. While the knobs 42 and the retention clips 39 are necessary only on one of the sub-assemblies 28, in a further embodiment, they could be present on both of the sub-assemblies to allow for additional security in the folded configuration or for simplicity of manufacturing. Additionally, a piece of spring steel 111 can be mounted to the mount 37 and that loops over a protrusion (not shown) on the bar 84 to help maintain the stability of the base frame 27 and helps keep the legs from folding in, which helps the base frame stay in the unfolded configuration. The piece of spring steel 111 would move away from the protrusion on the bar 84 if the user applies pressure to fold the legs 11. Also, caps 112 are inserted into the leg sleeves 26 from an opening 114 that is closest to the mount 37 to provide additional stability and limit how low the bar 84 can pushed into the mount 37.

Figure 5:
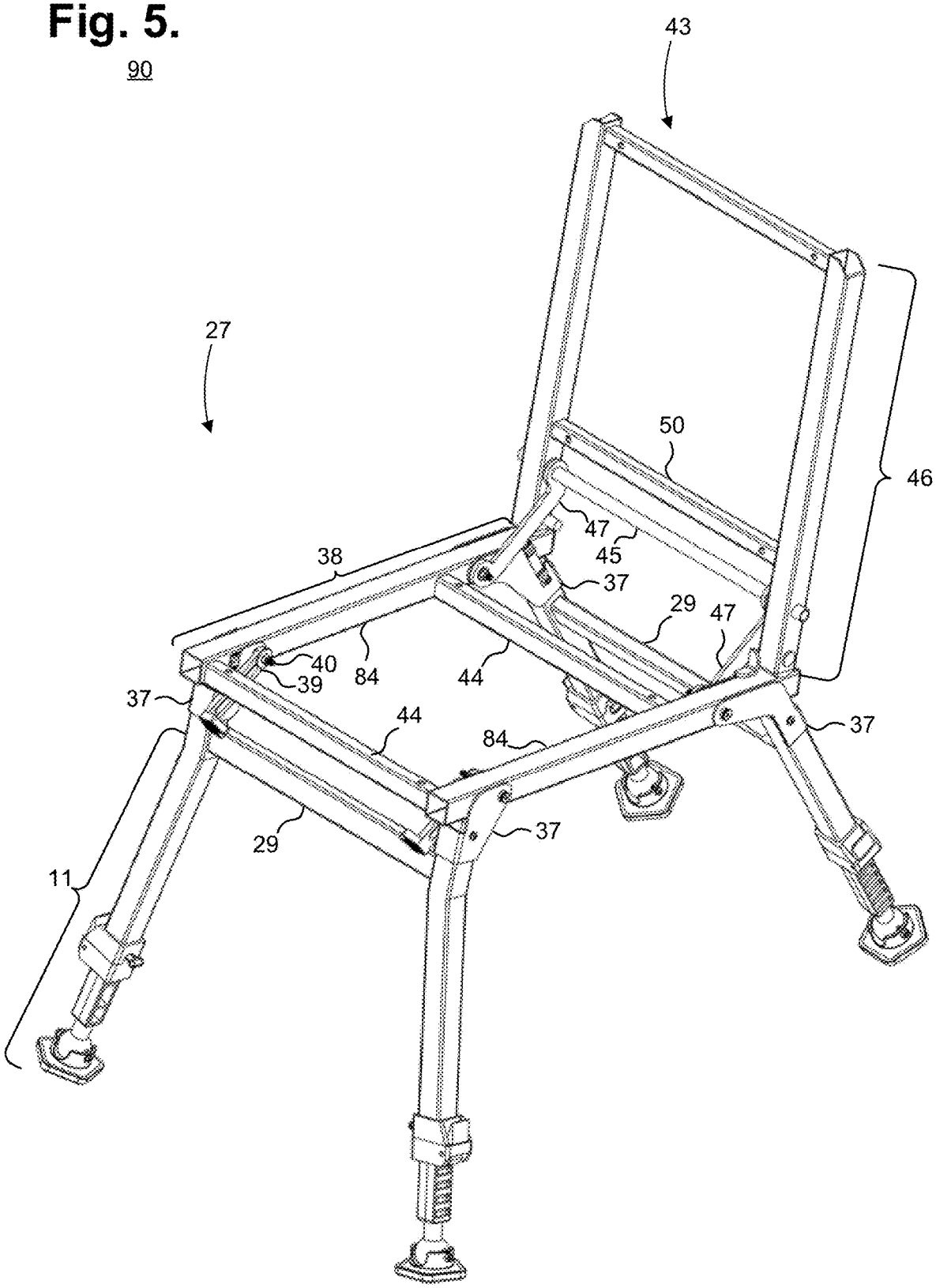
FIG. 5 is a diagram showing a chair frame that includes a base frame pivotally connected to a backrest frame in accordance with one embodiment.

The base frame 27 is completed by connecting the mounts 37 on both of the sub-assemblies 28 to a central sub-assembly 38, with the base frame 27 being connected to other components of the furniture assembly. FIG. 5 is a diagram showing a chair frame 90 that includes a base frame 27 pivotally connected to a backrest frame 43 in accordance with one embodiment. FIG. 6 is a diagram showing a sofa frame 191 that includes a base frame 27 pivotfally connected to a backrest frame 43 in accordance with one embodiment. The central sub-assembly 38 includes two bars 84 that each attached (such as via bolts 74) to one of the mounts 37 of both of the leg sleeve sub-assemblies 28. One or more support bars 44 are attached between the bars 84, providing additional structural support to the base frame for withstanding additional weight. The number of the support bars 44 can be dependent on the kind of furniture the furniture assembly implements. For example, as shown in FIG. 5, when the furniture is a chair, only two support bar 44 can be sufficient. When the furniture needs to support more weight, such as in the case of a sofa, more than two support bars 44 can be necessary.

When the furniture assembly implements a chair or a sofa or another piece of furniture upon which people generally lean their backs, a backrest frame 43 pivotally attaches to the base frame 27. The backrest frame 43 includes a support tube 45 attached to two sides of a rectangular frame 46. The rectangular frame 46 can also include one or more support bars 50. Two hinges 47 are attached (such as through welding, though other attachment techniques are also possible) to the support tube 45 adjacent to the sides of the rectangular frame 46. The end of each of the hinges 47 not attached to the support tube 45 are each rotatably attached to one of the mounts 37. The hinges 47 are attached to the mounts 36 on the same leg sleeve subassembly 28. The attachment of the hinges 47 to the mounts 37 can be done with bolts 40 and screws 41, with the bolt passing through aligned apertures in the mount 37 and the bar 84 attached to the mount 37. The attachment of the hinges 47 to the mounts 37 allows the hinges to rotate relative to the mount 37 with enough clearance even when the cushion 54 (described below is positioned over the base frame 27 once the user applies enough pressure to overcome the friction of the hinges 47 being attached to the mounts 37, thus allowing to collapse the backrest frame 43 to be substantially parallel to the central sub-assembly 38 when the furniture needs to be in the folded configuration and to lift the backrest frame 43 back to be substantially perpendicular to the central sub-assembly 38.

Figure 7:
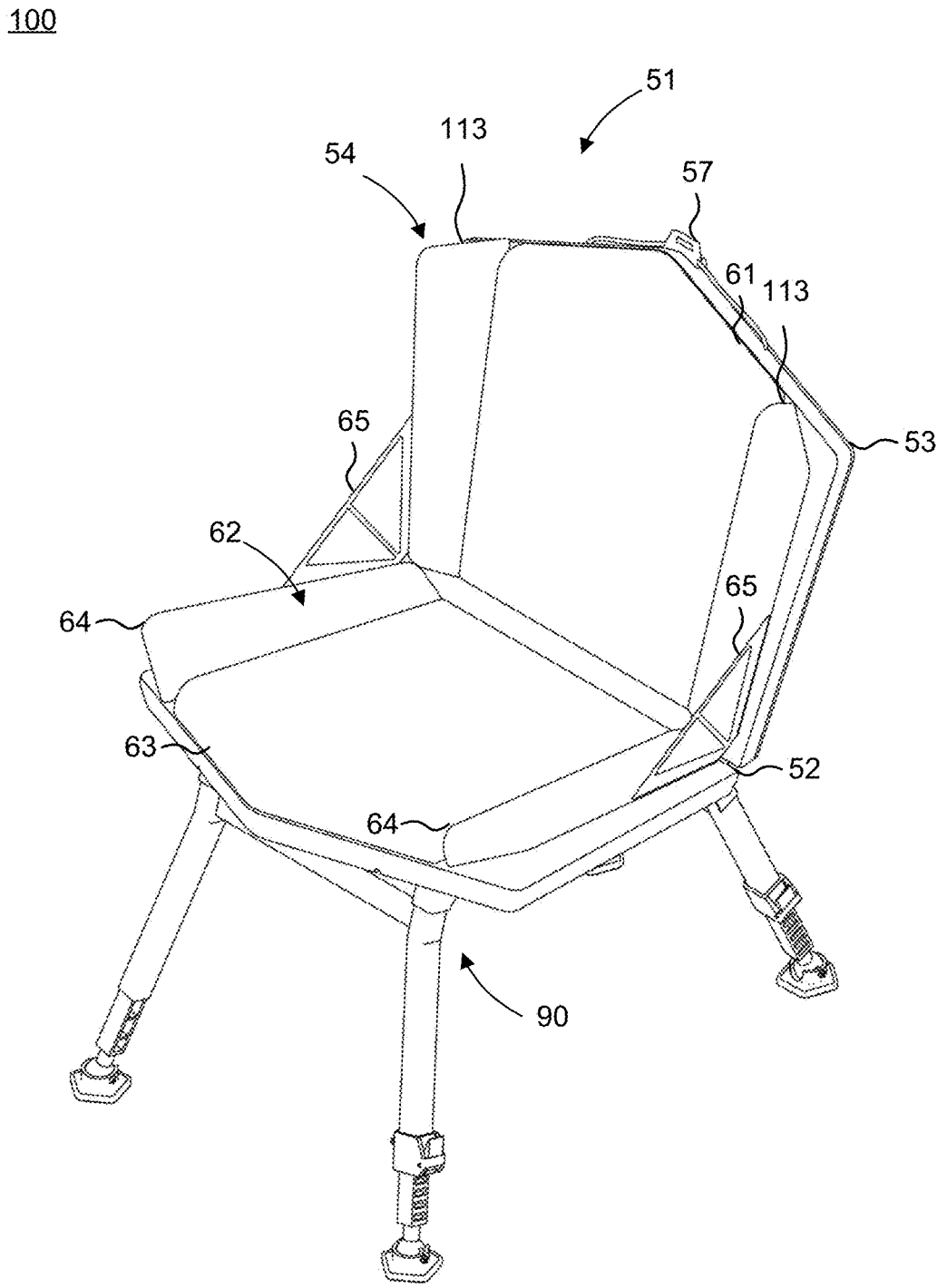
FIG. 7 is a diagram showing a chair body set on the chair frame of FIG. 5 accordance with one embodiment.
Figure 8:
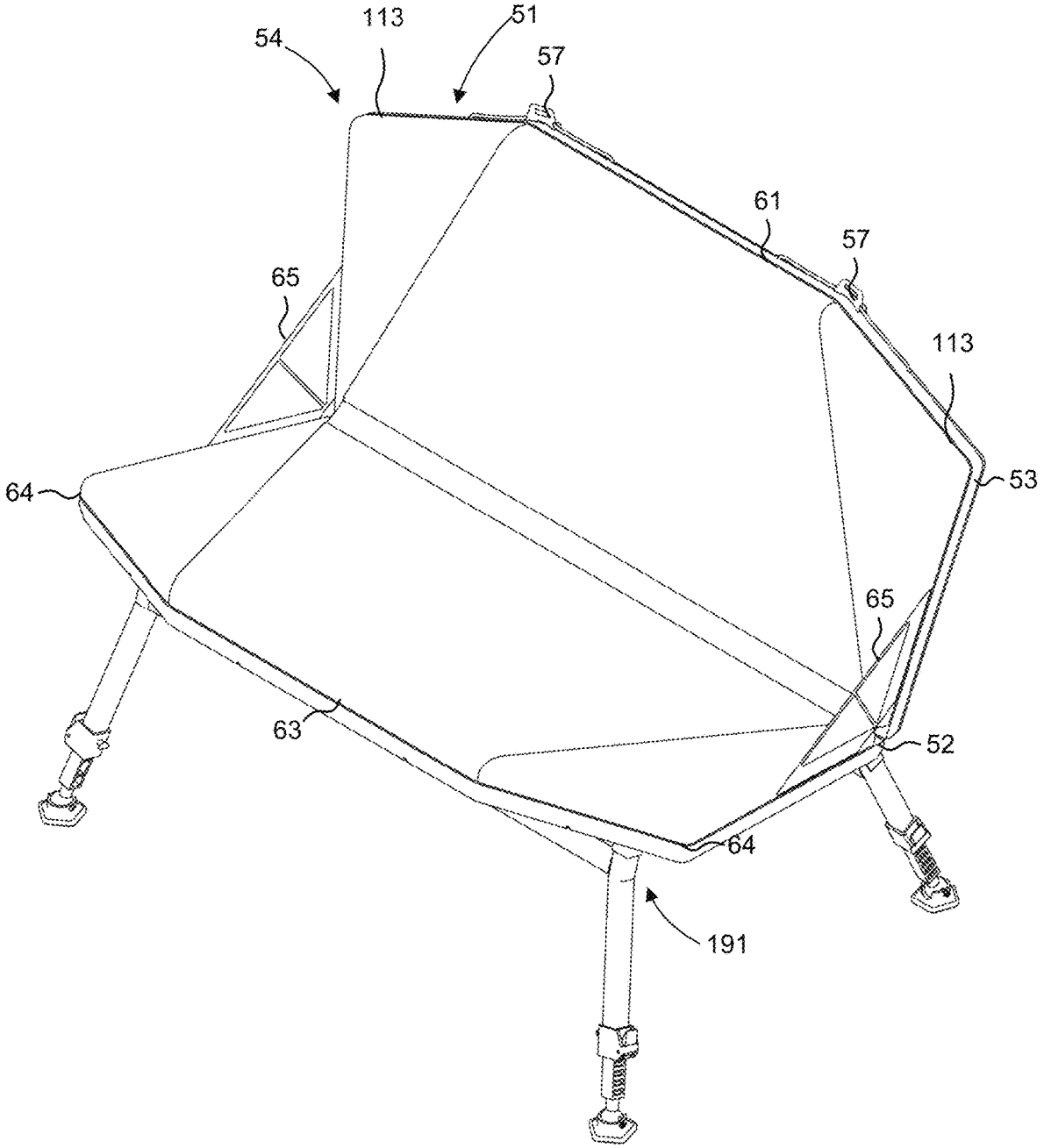
FIG. 8 is a diagram showing a sofa body set on the sofa frame of FIG. 6 in accordance with one embodiment.

The base frame 27, and in those embodiments where the furniture includes a backrest frame 43, are used as a basis on which the body of the furniture (the parts that come into most contact with the user when the furniture item is being used) can be set. FIG. 7 is a diagram showing a chair body 51 set on the chair frame 90 of FIG. 5 accordance with one embodiment. FIG. 8 is a diagram showing a sofa body 51 set on the sofa frame 191 of FIG. 6 in accordance with one embodiment. As seen with reference to both FIGS. 7 and 8, the furniture body for both the chair and the sofa includes a seat 52 that is attachable to the base frame 27; a backrest 53 that is set on the backrest frame 43; and a cushion 54 that can be secured to the backrest and the seat 52.

The seat 52 in both chair and sofa assemblies can be made of a polyethylene and include a plurality of indentations on the side of the seat facing the base frame 43 in order to lighten the seat 52 and increase the seat's 52 durability, though in a further embodiment, other materials and combinations of the materials can are possible.

Figure 9:
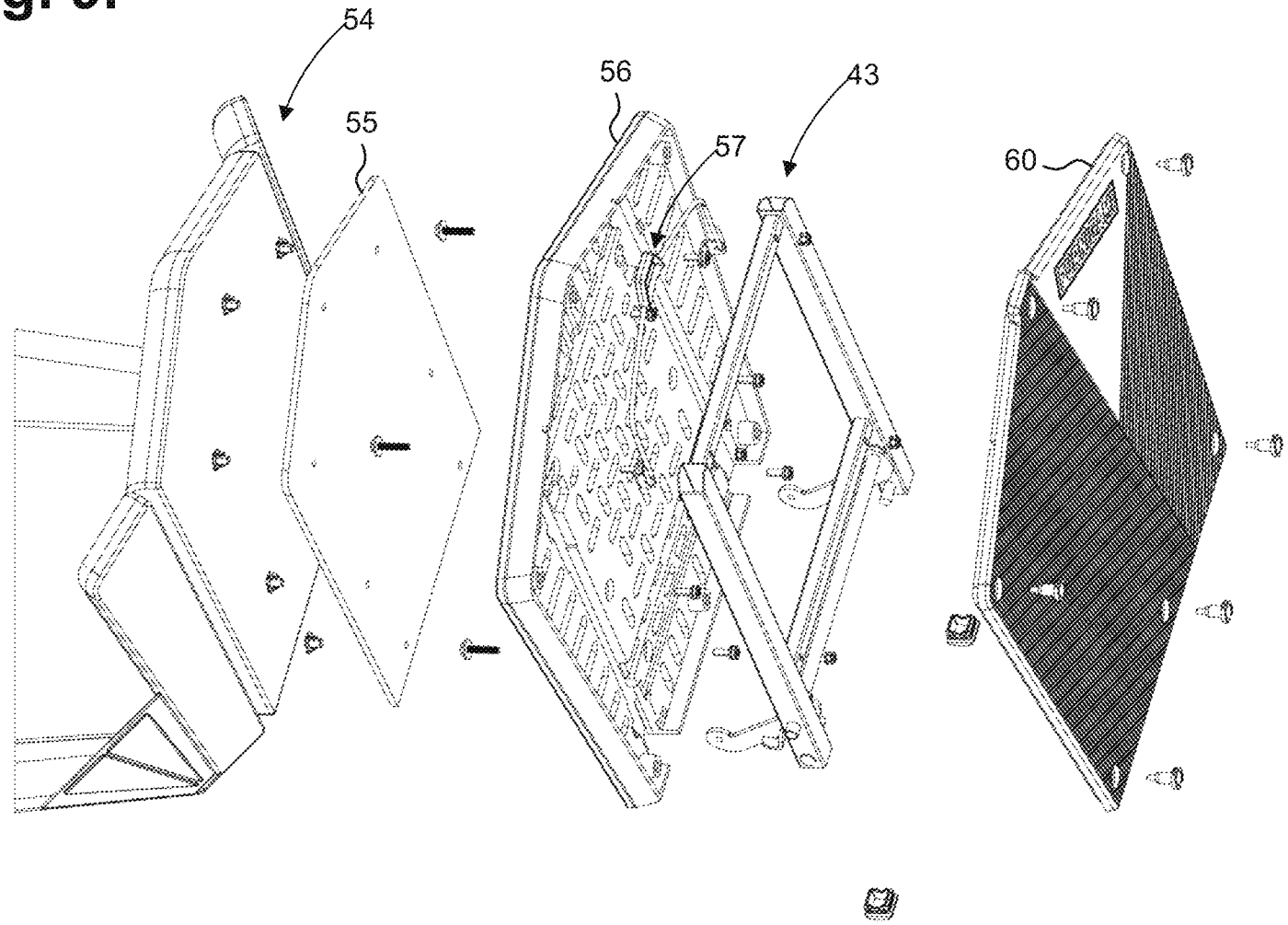
FIG. 9 is a diagram showing layers of the backrest together with the backrest frame of a chair and the cushion in accordance with one embodiment.

The backrest 53 in both the chair and sofa assemblies can include many layers. FIG. 9 is a diagram showing layers of the backrest 53 together with the backrest frame 43 of a chair and the cushion 54 in accordance with one embodiment. On the side facing the user, the first layer is an outer shell 55 that can be made of plastic (another material), which is attached to a chair cushion plate 56 that is made of a polyethylene (or another plastic) and that attaches to one side of the backrest frame 43 (the side facing the user sitting in the furniture). A back chair cover 60, which can be made of plastic or another hard material, attaches to the opposite side of the backrest frame 43 from the chair cushion plate 56. The cushion 54 attaches to the outer shell 55, such as with the fabric (or nylon or another material) material of the cushion 54 being stapled to the outer shell 55. Likewise, the bottom part of the cushion 54 (described below) can be stapled to the seat 52, though other attachment techniques are also possible.

In constructing the outer shell, the chair cushion plate 56 and the back chair cover are to the metal backrest frame 43 via bolts and nuts (though other attachment techniques are also possible). The cushion 55 can be attached to the outer shell 55 in a variety of ways, such as through bolts and nuts, though other attachment techniques can also be used.

A cord tab 57 is attached to the side of the chair cushion plate 56 facing the backrest frame 43 and whose end sticks out from the backrest when the backrest is assembled together. When the furniture is in the folded configuration, the end of the cord tab hooks onto a retaining clip (not shown) positioned on the side of the seat facing the base frame 27, thus securing the backrest 53 to the seat 52 and requiring user action for the transition of the furniture assembly back into the unfolded configuration.

As can be seen in FIGS. 8 and 9, the cushion 55 includes several portions. One portion is a backrest portion 61 that is secured to the backrest 53 and a seat portion 62 that is secured to the seat (such as through bolts and nuts, though other attachment techniques can also be used). The seat portion 62 in turn includes a central portion 63 that directly attaches to the central sub-assembly 38 and two flaps 64 that are on each side of the central portion 63. Each of the flaps 64 are connected to the backrest portion 61 by a support structure 65 that attaches to a flap 113 of the backrest portion 61. In the embodiment where the furniture assembly 100 forms a chair, when a user seats in the chair and leans back against the flaps 113 of the backrest portion 61 the tension applied through the support structures 65 lifts the flaps relative to the central portion 63, thus providing additional support to sides of the hips and buttocks of the person sitting in the chair. When the furniture assembly 100 forms the sofa, the flaps 65 are flush with the seat 52 even in the unfolded configuration (though in a further embodiment, lifting of the flaps 65 for the sofa is also possible).

When the furniture assembly 100 forms a chair or a sofa, the furniture assembly can be folded and unfolded similarly for both furniture items. To fold an unfolded furniture item for transport, the user would pull the leg sleeve sub-assemblies 28 (and consequently the legs 11) towards each other and secure the leg joints 12 in one leg sleeve sub-assembly to the leg joints 12 in another leg sleeve sub-assembly 28 by hooking the knobs 42 on one sub-assembly 28 in retention clips 39 in another sub-assembly 39. Optionally, the user would push rotate the foot joint to be on the side of the ball joint that would not be facing the ground if the furniture was unfolded. The user would also push down the backrest 53 to be parallel to the seat 52 and secure them in this position by attaching the cord tab 57 to the retaining clip 52 on the seat. Unfolding of the furniture item into the configuration ready for use would require performing these actions in reverse.

While the base frame 27 can attach to the backrest frame 43 to form a sofa or a chair (or in a further embodiment, other kinds of furniture), the base frame 27 can also be used to form a table. FIG. 10 is a diagram of the furniture assembly 100 forming a table in accordance with one embodiment. In this embodiment, the furniture body is a table top 66 attached to the base frame 27. FIG. 11 is a diagram showing a side of the table top 66 that is attached to the base frame 27 in accordance with one embodiment. The table top 66 can be made of polyethylene (or another plastic) and can include indentations 67 for greater durability. The table top includes a central portion 68 and two table top wings 69 pivotally attached to the central portion, with the wings 69 being coplanar with the central portion 68 when the table is in the unfolded configuration and being foldable to be under the central portion 68 when the table needs to be folded. The base frame 27 attached to the central portion 68 (such as through bolts and nuts) in this embodiment differs in some aspects from the base frame 27 when the furniture assembly 100 forms a chair or a sofa.

In particular, both of the mounts 37 of each of the leg sleeve subassembly 28 attach to a connector tube 81 that are part of the central sub-assembly 38 and are positioned between the mounts 37 (thus two connector tubes 81 being present in the base frame 27). The central sub-assembly further includes two connector bars 82, each of the connector bars 82 attached both of the connector tubes 81. A support bar 83 is positioned substantially an equal distance between the two connector tubes 81 and is the attached to the connector bars 82. The base frame 27 further includes two lock bars 84. One end of each of the locks bars 184 is attached to the support bar 83 and another end of the lock bars 184 is attached to one of the connector bars 29 (with the lock bars 184 being attached to different connector bars 29). Each of the lock bars 184 is made of two pivotally connected pieces. Each of the lock bars 84 further includes a sleeve 85 (which can be made of metal or another material) that is moveable along the length of the lock bars 184; when the sleeve is at the end of the lock bar 84 closest to the attached connector tube 81 and over the joint by which the two pieces are connected, the two pieces of the lock bars 184 cannot pivot and thus the lock bars 184 are locked in an extended configuration and prevent the legs 11 from being folded towards each other (and thus prevent the furniture assembly 100 from folding). If a user moves the sleeve 85 away from the connector tube 81, the lock bars become collapsible, and thus allow the legs 11 to be brought towards each other and for the table to be folded.

Figure 12:
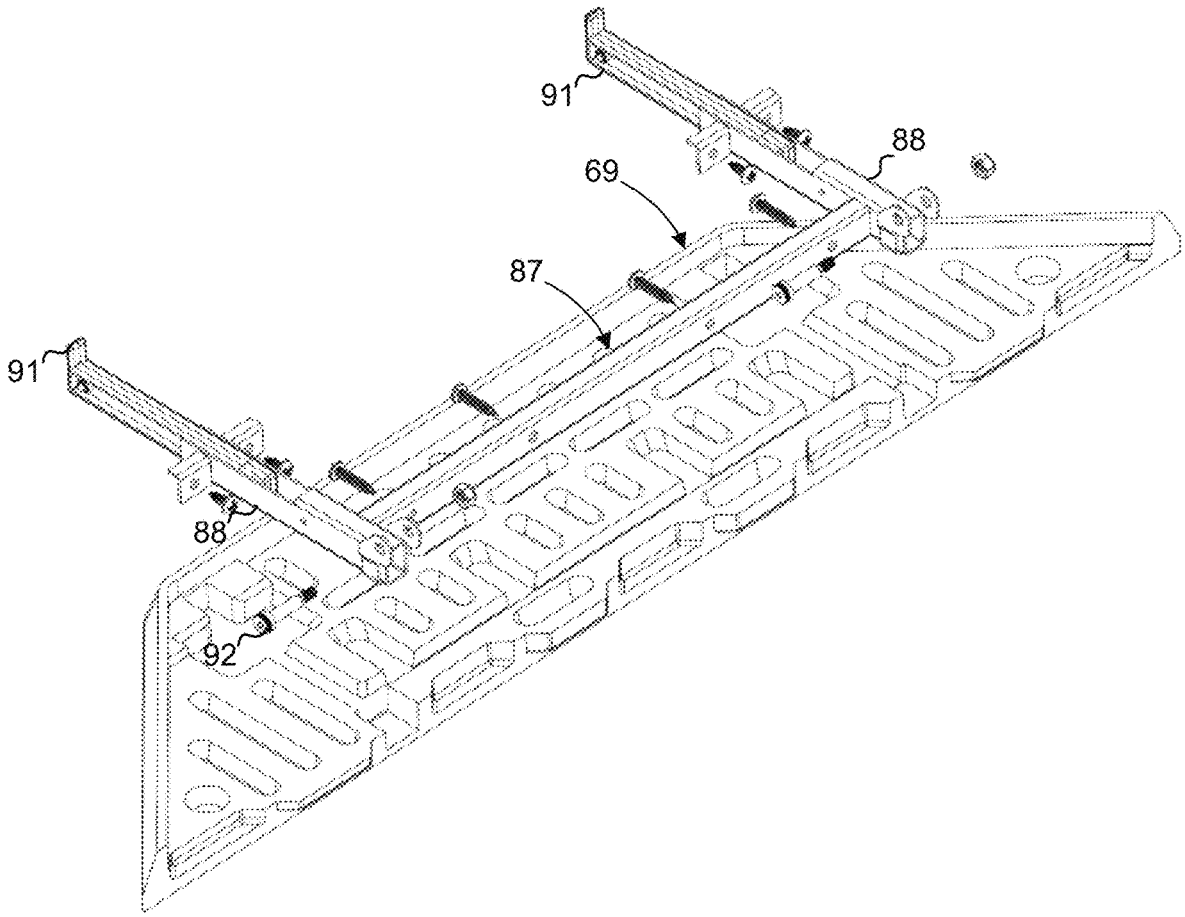
FIG. 12 is a diagram showing a table wing support assembly on top of a table wing in accordance with one embodiment.
Figure 13:
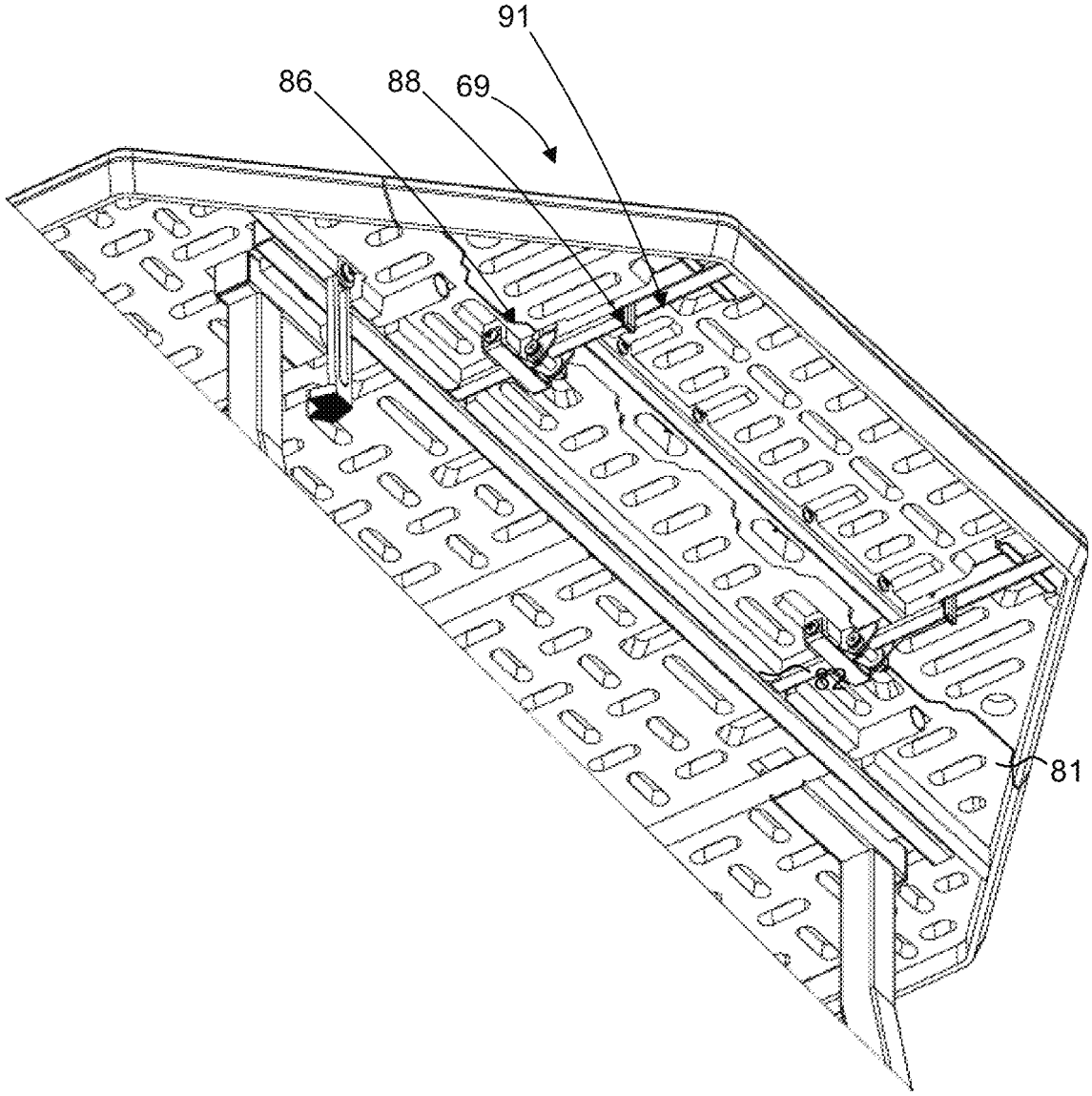
FIG. 13 is a diagram showing a close-up of a portion of furniture assembly forming a table showing the locks inserted into table wing connecting extensions and the hollow extensions in accordance with one embodiment.

In this embodiment, the central assembly 38 includes components for connecting to the table top wings 69. On each of the connector bars 83 are formed table wing connecting extensions 86, with each extension including an opening and apertures into which bolts can be inserted. Each of the wings 69 is attached to a table wing support assembly 87 (such as through bolts and nuts), with each wing support assembly 87 being pivotally attachable to the table wing connecting extensions 86 on one of the connector bars 83. FIG. 12 is a diagram showing a table wing support assembly 87 on top of a table wing 69 in accordance with one embodiment. The assembly 87 includes hollow extensions 88 that include an opening 89 and that pivotally attaches to the table wing connecting extensions 86 of the central assembly 38, such as being mounted on a common bolt 92. A table wing lock 91 is insertable into each of the extensions 88 and when the extension is inserted into the table wing connecting extension 86, the lock 91 passes into the extension 86 of the central assembly 38 when the table is in the unfolded configuration and the wings 69 are in the plane as the central portion 68 of the table top 66. The insertion of the locks into both the extension 88 and the extension 86 prevents the pivoting of the extension 88 relative to the extension 86 and thus prevents the wings 69 from moving relative to the central portion 68. FIG. 13 is a diagram showing a close-up of a portion of furniture assembly forming a table showing the locks 91 inserted into table wing connecting extensions 86 and the hollow extensions 88 in accordance with one embodiment. The removal of the locks 91 from the extensions 88 and 86 inn turn allows the wings to fold under the central portion of the table.

When the furniture assembly 100 the chair, the furniture assembly can be folded and unfolded similarly to what is described above with reference to chair and sofa. To fold an unfolded furniture item for transport, the user would move the sleeves 85 towards the support bar 83 and collapse the lock bars 184, thus allowing to pull the leg sleeve sub-assemblies 28 (and consequently the legs 11) towards each other and secure the leg joints 12 in one leg sleeve sub-assembly to the leg joints 12 in another leg sleeve sub-assembly 28 by hooking the knobs 42 on one sub-assembly 28 in retention clips 39 in another sub-assembly 39. Optionally, the user would push rotate the foot joint to be on the side of the ball joint that would not be facing the ground if the furniture was unfolded. The user would also remove the four locks from the extensions 88 and 86. Unfolding of the furniture item into the configuration ready for use would require performing these actions in reverse.

Figure 14:
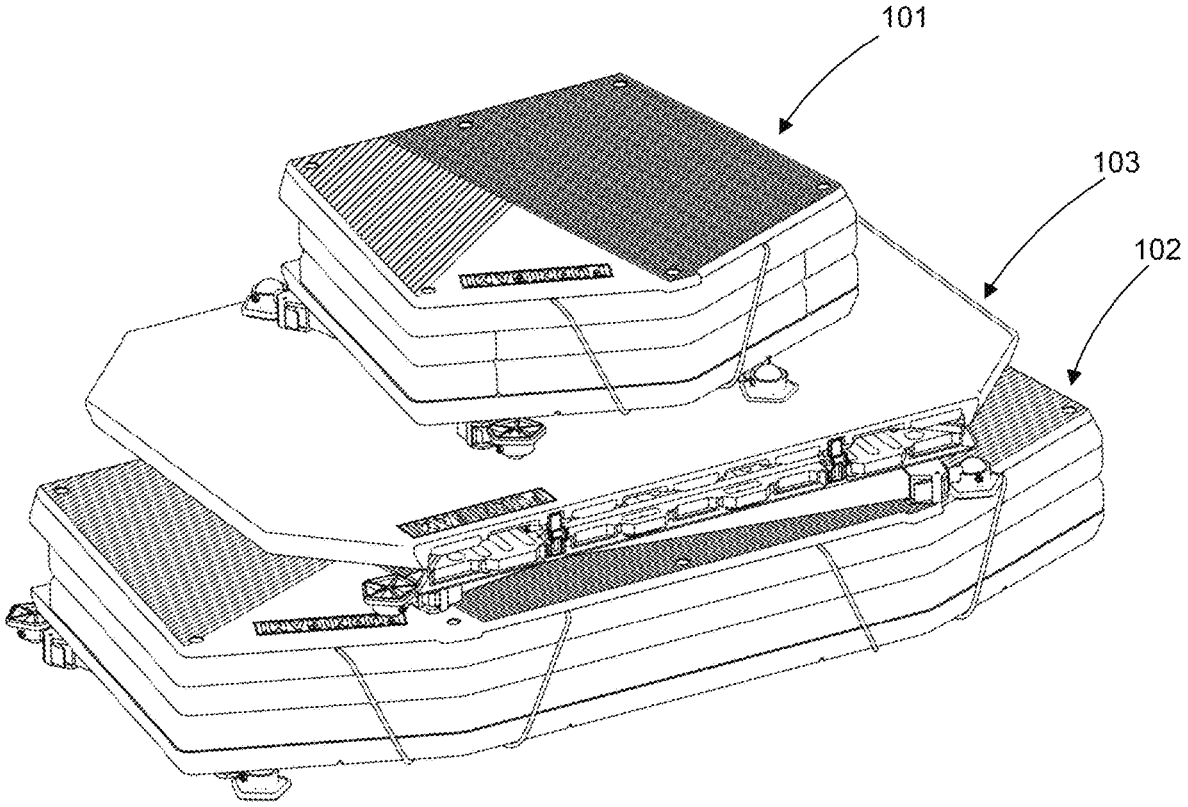
FIG. 14 is a diagram showing the chair 101, the sofa 102 of FIG. 8, and the table of FIG. 10 in the folded configuration and stacked on top of each other.

The furniture items formed by the furniture assembly in different embodiments have a similar shape when folded, simplifying their transportation as an ensemble. FIG. 14 is a diagram showing the chair 101, the sofa 102 of FIG. 8, and the table of FIG. 10 in the folded configuration and stacked on top of each other.

While the invention has been particularly shown and described as referenced to the embodiments thereof, those skilled in the art will understand that the foregoing and other changes in form and detail may be made therein without departing from the spirit and scope.

What is claimed is:

1. A foldable furniture assembly, comprising:

a plurality of leg joints, each leg joint comprising a plurality of indentations;

a plurality of ratchet leg sleeves, each of the ratchet sleeves fittable around one of the joint legs and movable along at least a portion of a length of that leg joints along the indentations;

a plurality of toggles, each of the toggles configured to secure one of the ratchet leg sleeves to one of the leg joints using one of the indentations; and a base frame attachable to a body of a furniture item and comprising a plurality of leg sleeve sub-assemblies rotatably attachable to a central sub-assembly, the sub-assemblies comprising a plurality of outer leg sleeves, wherein each of the leg joints is insertable into one of the outer leg sleeves to a level on which the ratchet leg sleeve is set on that leg joint, wherein the leg sleeve subassemblies are configured to rotate relative to the central sub-assembly when the furniture item switches from an unfolded configuration to a folded configuration.

2. An assembly according to claim 1, further comprising:

a plurality of ball joints, each ball joint set at an end of each of the leg joints; and a plurality of foot joints, each foot joint rotatably set upon one of the ball joints.

3. An assembly according to claim 2, wherein each of the ball joints comprises a tapered slot through which a bolt is inserted to secure one of the foot joints to that ball joint.

4. An assembly according to claim 1, wherein one or more of the leg joints are hollow.

5. An assembly according to claim 4, wherein one or more of the hollow leg joints comprise openings.

6. An assembly according to claim 1, wherein the furniture item is a chair, further comprising the furniture item body further comprising:

a seat attachable to the base frame;

a backrest frame rotatably attachable to the base frame;

a backrest set on the backrest frame; and a cushion securable to the backrest and the seat, wherein the cushion comprises a backrest portion that is securable to the backrest and a seat portion that is securable to the seat, the seat portion comprising two flaps that each is on a connected to the backrest portion by two support structures that are each attached to a side of the backrest and a side of one of the flaps, wherein the flaps are lifted when the furniture item body is in the unfolded configuration due to tension applied through the support structures.

7. An assembly according to claim 6, wherein the lifted flaps provide support to hips and buttocks of a person that sits in the chair.

8. An assembly according to claim 1, further comprising a backrest frame attached to the base frame, wherein the backrest frame comprises a support tube attached to two sides of a rectangular frame.

9. An assembly according to claim 8, wherein the rectangular frame comprises one or more support bars.

10. An assembly according to claim 8, wherein each of the leg sleeve subassemblies further comprises a mount, further comprising:

a plurality of hinges, each attached to the support bar and rotatably attached to one of the mounts.

11. An assembly according to claim 10, wherein a rotation of the hinges relative to the mounts allows to collapse the backrest frame to be substantially parallel to the central sub-assembly in the folded configuration and to lift the backrest frame to be substantially perpendicular sub-assembly in the unfolded configuration.

12. An assembly according to claim 10, wherein the central sub-assembly and the mounts comprise apertures and wherein the hinges are attached to the mounts using bolts inserted through the apertures of the mounts and the central subassembly.

13. An assembly according to claim 10, wherein the central sub-assembly and the mounts comprise apertures and wherein the hinges are attached to the mounts using bolts inserted through the apertures of the mounts and the central subassembly.

14. An assembly according to claim 10, wherein the hinges are welded to the support bar.

15. An assembly according to claim 8, further comprising a backrest attached to the backrest frame, the backrest comprising a plurality of layers.

16. An assembly according to claim 15, wherein the layers comprise an outer shell comprising plastic, a cushion plate attached to the outer shell and to a side of the backrest frame, and a back chair cover attached to an opposite side of the backrest frame.

17. The foldable furniture assembly according to claim 1, wherein the furniture item is a table comprising a table top attachable to the base frame, the table top further comprising a central portion and two wings pivotally attached to the central portion.

18. The foldable furniture assembly according to claim 17, wherein a portion of the wings that faces the central portion of the table top when the table is in the unfolded configuration comprises a plurality of receding portions.

19. An assembly according to claim 17, wherein the leg sleeve subassemblies each comprise a mount, further comprising:

two connector tubes, each comprised in the central subassembly and mounted on two of the mounts; and two connector bars, each attached to both of the connector tubes.

20. An assembly according to claim 19, further comprising:

a support bar to each of the connector bars;

two lock bars, each attached to the support bar, wherein the lock bars prevent the base frame from adopting the folded configuration when in a locked state and allow the base frame to adopt the folded configuration when in an unlocked state.

* * * * *